US005310371A

United States Patent [19]

Iriono et al.

[11] Patent Number: 5,310,371

[45] Date of Patent: May 10, 1994

[54] TANDEM PROPELLER ASSEMBLY FOR A MARINE PROPULSION UNIT

[75] Inventors: Yasushi Iriono; Yoshitsugu Sumino; Mitsunori Suzuki; Hiroshi Harada, all of Hamamatsu, Japan

[73] Assignee: Sanshin Industries Co., Ltd., Shizuoka, Japan

[21] Appl. No.: 935,416

[22] Filed: Aug. 26, 1992

[30] Foreign Application Priority Data

Aug. 27, 1991 [JP] Japan ..... 3-239001

[51] Int. Cl.[5] ..... B63H 1/14

[52] U.S. Cl. ..... 440/80; 440/81; 440/52

[58] Field of Search ..... 440/52, 80, 81, 83, 440/79, 900; 267/136, 140.1 C; 403/220, 221, 225, 228; 464/51, 69, 86, 92

[56] References Cited

U.S. PATENT DOCUMENTS

| | | | |
|---|---|---|---|
| 374,985 | 12/1887 | Merlette | 440/81 |
| 1,001,984 | 8/1911 | Rolka | 440/80 |
| 1,360,037 | 11/1920 | Shunnard | 440/80 |
| 2,672,115 | 3/1954 | Conover . | |
| 2,691,356 | 10/1954 | Waterval | 440/81 |
| 2,772,649 | 12/1956 | Gensheimer | 440/52 |
| 4,486,181 | 12/1984 | Cavil | 440/900 |

*Primary Examiner*—Robert J. Oberleitner
*Assistant Examiner*—Clifford T. Bartz
*Attorney, Agent, or Firm*—Bacon & Thomas

[57] ABSTRACT

A tandem propeller assembly for use with a marine propulsion unit is disclosed wherein a single shock-absorber assembly is utilized to assure damping effects for both propellers so as to protect the propulsion system from being damaged when either propeller is obstructed by drifting wood or other debris. Each of the preferred embodiments disclosed provides a simple structure for absorbing impacts upon either propeller in a tandem propeller assembly while minimizing any increase in the surface area of contact with the water which would increase the propulsion resistance and would result in speed loss.

30 Claims, 5 Drawing Sheets

TANDEM PROPELLER ASSEMBLY FOR A MARINE PROPULSION UNIT

BACKGROUND OF THE INVENTION

1. Field of the Invention

The present invention pertains to a tandem propeller assembly for use on a marine propulsion unit and, more particularly, a tandem propeller assembly which utilizes a single shock-absorber arrangement between a drive shaft of the marine propulsion unit and both of the tandem propeller units.

2. Discussion of the Prior Art

U.S. Pat. No. 2,672,115 discloses the concept of utilizing tandem propellers in a marine propulsion unit. In this patented arrangement, each of the propellers are attached to a drive shaft of the marine propulsion unit. By appropriately designing their diameters, pitch and relative positions, the tandem propellers can be used to improve the propulsion efficiency with respect to load in various types of watercrafts.

In this prior art arrangement, the tandem propellers are not affixed to the drive shaft by a shock-absorber. Instead, a complex protective structure is utilized to protect the propulsion system from being damaged when drifting wood or other debris strikes either of the propellers. Although it is technologically possible to construct a specialized shock-absorber for each of the propellers when a plurality of propellers are mounted in tandem, this would inherently lengthen the collars associated with the propellers. The longer the propeller collar, the greater the contact surface with the water which results in increased propulsion resistance and speed loss.

Therefore, there exists a need in the art for a marine propulsion unit which utilizes a tandem propeller assembly incorporating a shock-absorber between the propellers and the drive shaft. In addition, there exists a need in the art for a tandem propeller assembly incorporating a shock-absorber wherein the length of the collars associated with the propellers can be minimized so as to maintain a low propulsion resistance during operation. Finally, there exists a need in the art for a shock-absorbing arrangement for use with a tandem propeller assembly of a marine propulsion unit which is simple in structure and which can functionally protect the propulsion system from damage when the propellers are obstructed by drifting wood or other debris during operation.

SUMMARY OF THE INVENTION

It is an object of the present invention to provide a tandem propeller assembly for use in a marine propulsion unit which incorporates a shock-absorbing arrangement between the drive shaft of the propulsion unit and the tandem propeller assembly.

It is another object of the present invention to provide a single shock-absorber unit which acts between the drive shaft and each of the tandem propellers so as to minimize the required lengthening of the propeller collars to effectively minimize the surface area of the collars in contact with water, thereby lowering propulsion resistance and speed loss.

It is an additional object of the present invention to incorporate a shock-absorber for use between a tandem propeller assembly and a drive shaft of a marine propulsion unit which will function to protect the propulsion system from being damaged by drifting wood or other debris coming into contact with the propellers during operation thereof in a simple and compact manner.

These and other objects of the present invention are accomplished by providing a single shock-absorber unit which acts between the drive shaft of a marine propulsion unit and each propeller of a tandem propeller assembly. By incorporating a shock-absorber between the propellers and the drive shaft, the propulsion system will be protected from being damaged by drifting wood or other debris hitting the propeller. Further, utilizing a single shock-absorber for both propellers will minimize the necessary lengthening of the propeller collars so as to effectively decrease the surface area in contact with the water thereby lowering the propulsion resistance and the resulting speed loss.

In a first embodiment of the invention, one of the propellers is drivingly connected to a drive shaft of the marine propulsion unit through the shock-absorber and the second propeller unit is drivingly connected to the drive shaft through the first propeller and an intermediate driving member. In two other embodiments of the invention, one of the propeller units is connected to the drive shaft through the shock absorber and directly drives the other propeller unit. In still another embodiment of the invention, the shock absorber drivingly interconnects an intermediate driving member to the drive shaft and each of the propeller units are separately, drivingly connected to the intermediate driving member.

Other objects, features and advantages of the invention shall become apparent from the following detailed description of the preferred embodiments thereof, when taken in conjunction with the drawings wherein like reference characters refer to corresponding parts in the several views.

DETAILED DESCRIPTION OF THE PREFERRED EMBODIMENTS

Figure 1:
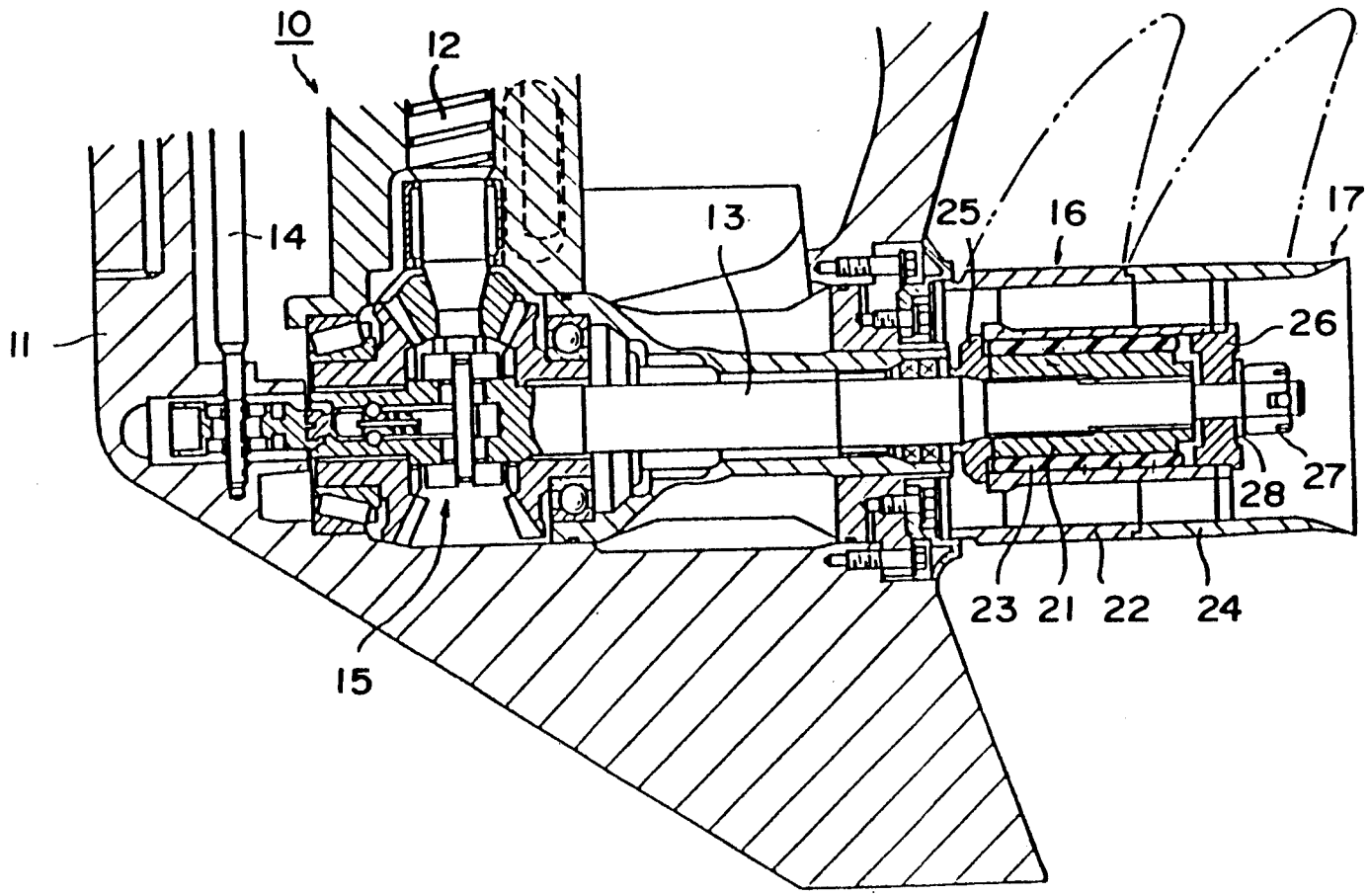
FIG. 1 is a cross-sectional view of the principal parts of an outboard engine incorporating a tandem propeller assembly according to a first embodiment of the invention.

With initial reference to FIG. 1, the lower portion of an outboard engine is generally indicated at 10 and includes a casing 11 within which is rotatably mounted a drive shaft 12. As depicted, drive shaft 12 extends generally vertically and transmits power to a propeller shaft 13, which is generally horizontally supported for rotation within casing 11, through a forward/reverse gear device 15. As is generally known in the art, forward/reverse gear device 15 can be controlled to alter the rotational direction of propeller shaft 13 by means of a shift device 14. Since the specific manner in which the power from the drive shaft 12 to the propeller shaft 13 through forward/reverse gear device 15 is not considered part of the present invention, the details of this arrangement will not be further discussed herein but is commonly known in the art. Propeller shaft 13 is used to drive two propeller units 16 and 17 mounted fore and aft in a tandem manner on an end portion of propeller shaft 13 which projects rearward from casing 11.

Figure 3:
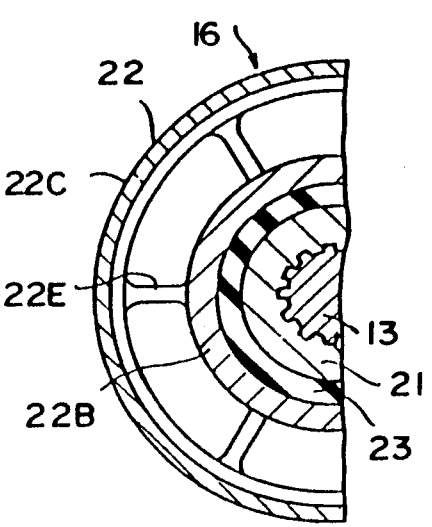
FIG. 3 is a partial, cross-sectional view taken along line A—A in FIG. 2.
Figure 4:
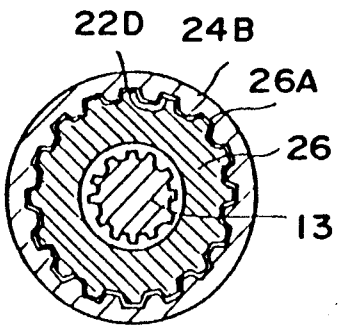
FIG. 4 is a cross-sectional view taken along line B—B in FIG. 2.
Figure 2:
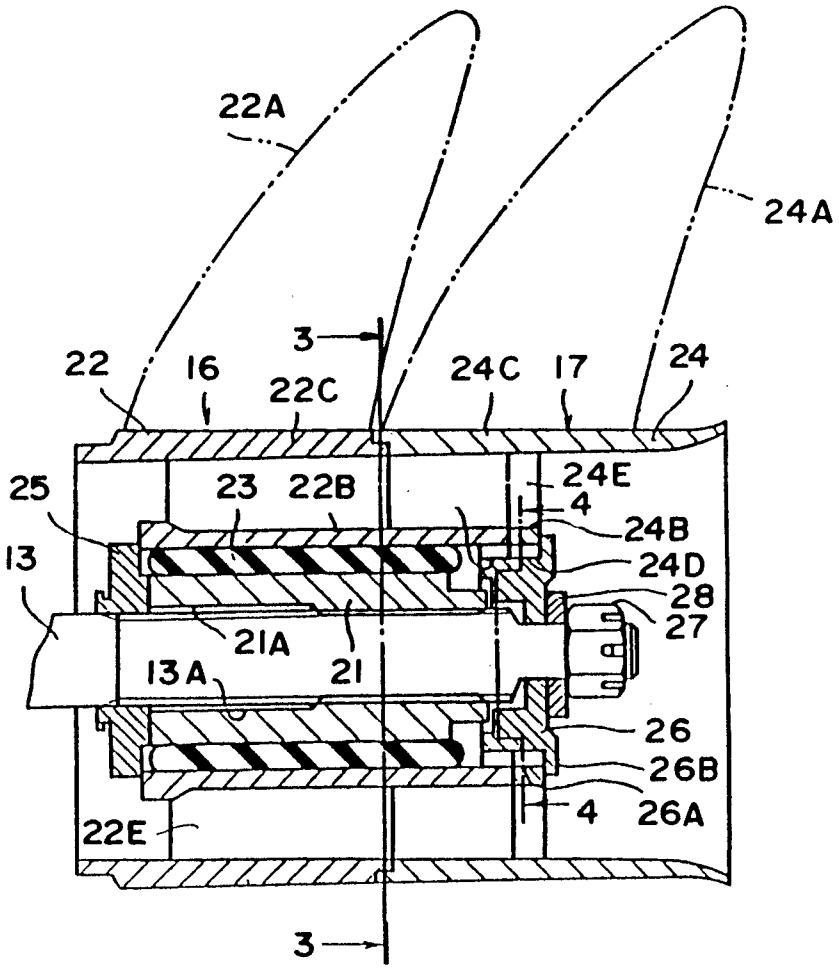
FIG. 2 is an enlarged view of the tandem propeller assembly shown in FIG. 1.

With specific reference to FIGS. 2–4, the manner in which propeller units 16 and 17 are mounted to and driven by propeller shaft 13 in accordance with a first embodiment of the invention will now be described. Propeller shaft 13 includes longitudinally extending splines 13A which are interengaged with splines 21A formed on an inner collar member 21 such that rotation of propeller shaft 13 causes rotation of inner collar 21. Propeller 16 includes an outer collar 22 having blades 22A fixedly secured thereto or integrally formed therewith. More specifically, propeller 16 includes an inside cylinder 22B and an outside cylinder 22C connect by radial spokes 22E which combine to constitute outer collar 22. On the inside diameter of the rear portion of inside cylinder 22B, a splined area 22D is formed. A shock-absorber 23 is secured between inner collar 21 and inside cylinder 22B such that rotation of inner collar 21 will cause rotation of propeller 16. In the preferred embodiment, shock absorber 23 is formed form an elastic member, preferably rubber, which has been fuse bonded between inner collar 21 and inside cylinder 22B.

Propeller 17 includes a collar 24 having blades 24A secured thereto or integrally formed therewith. Collar 24 is comprised of a short inside cylinder 24B and an outside cylinder 24C. The inside periphery of inside cylinder 24B is formed with a splined area 24D connected by spokes 24E. Both propellers 16 and 17 are mounted about propeller shaft 13 between a forward thrust receiving member 25 and a rearward thrust receiving member 26. Propellers 16 and 17 are preventing from moving in the axial direction of propeller shaft 13 by a nut 27 and a washer 28 which bears against rear thrust receiving member 26. Rear thrust receiving member 26 includes an outer, circumferential splined area 26A which is intermeshed with both the splined area 22D formed on the inside periphery of the rear end of inside cylinder 22B and splined area 24D formed on the inside diameter of inside cylinder 24B to thereby connect the propeller units 16, 17 together positively for corotation. Therefore, rear thrust receiving member 26, which includes a rear thrust receiving area 26B which comes into contact with the rear end surface of inside cylinder 24B of collar 24, drivingly interconnects inside cylinder 24B of propeller 17 to inside cylinder 22B of propeller 16.

As evident from the above description, propeller 17 does not includes its own shock-absorber. Instead, propeller 17 is linked by the spline connection to the rear thrust receiving member 26 and thereby joined to propeller 16. In this manner, propeller 17 is linked to shock-absorber 23 of propeller 16. With this construction, when either propeller 16 or 17 is struck by wood or other debris during operation, shock-absorber 23 will protect the propulsion system from being damaged. Since a separate shock-absorber is not utilized for propeller 17, the propeller collar length can be greatly reduced, thereby effectively reducing the contact surface area of the propeller assemblies with the water so as to minimize the resulting propulsion resistance and speed loss.

Figure 6:
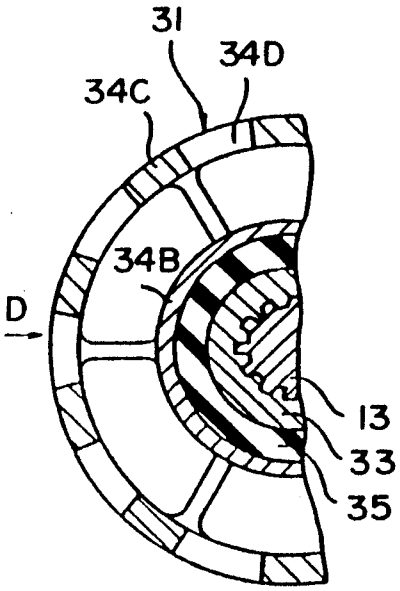
FIG. 6 is a partial, cross-sectional view taken along line C—C in FIG. 5.
Figure 7:
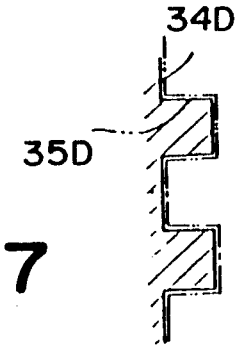
FIG. 7 is an enlarged view of a portion of FIG. 5 depicting the interconnection between the tandem propellers.
Figure 5:
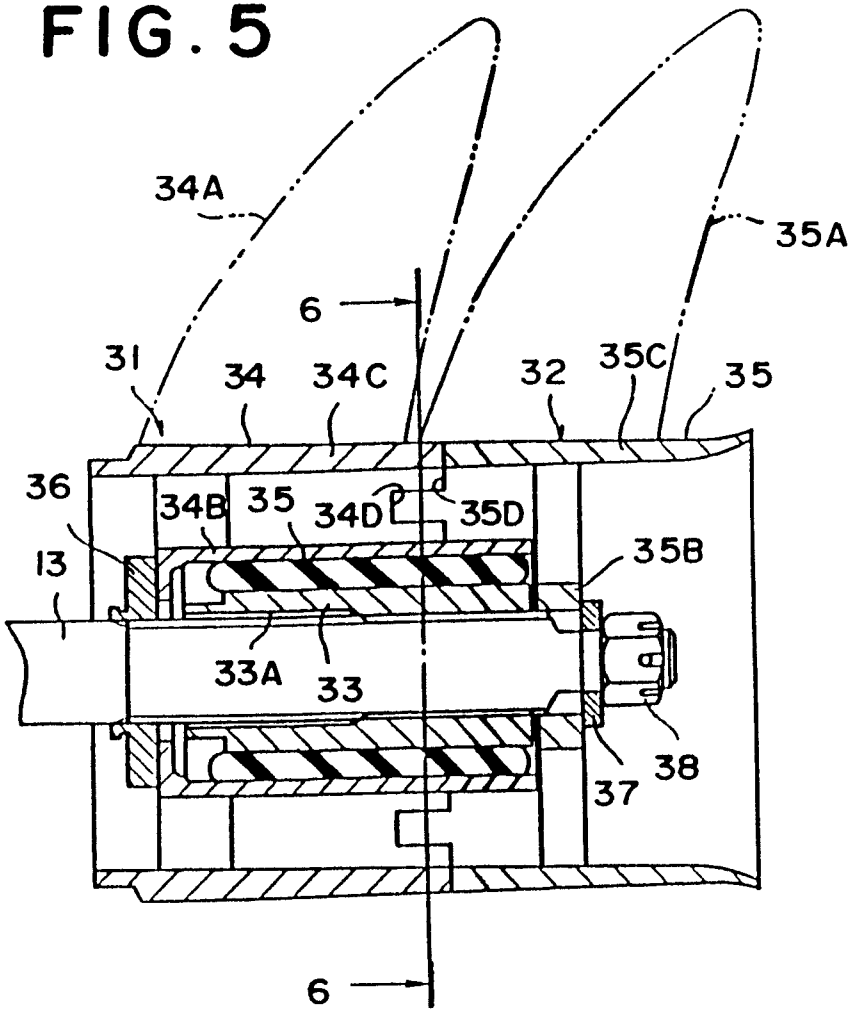
FIG. 5 is a cross-sectional view showing a tandem propeller assembly according to a second embodiment of the invention.

Reference will now be made to FIGS. 5–7 in describing a second embodiment of the invention. As in the first embodiment, propeller shaft 13 is spline connected at 33A to an inner collar 33. Propeller 31 includes an outer collar 34 which carries a plurality of blades 34A. Outer collar 34 includes an inside cylinder 34B and an outside cylinder 34C. A shock-absorber 35, made of an elastic material such as rubber, is fused in the space between inner collar 33 and inside cylinder 34B. By this arrangement, rotation of propeller shaft 13 will rotate blades 34A through inner collar 33, shock absorber 35, inside cylinder 34B and outside cylinder 34C.

Propeller 31 is further formed with an annular toothed engagement area 34D on the rear end of outside cylinder 34C. Rear propeller 32 includes a collar 35 which carries blades 35A. Collar 35 has a short inside cylinder 35B and an outside cylinder 35C. The front end of outside cylinder 35C is formed with a toothed engagement area 35D which is interengaged with toothed engagement area 34D formed on the back end of outside cylinder 34C. Due to the interengagement of toothed engagement areas 34D and 35D, the drive from propeller shaft 13 that is transmitted to propeller 31 through inner collar 33 and shock absorber 35 will also cause rotation of propeller 32.

Propellers 31 and 32 are mounted about propeller shaft 13 between a forward thrust receiving member 36 and washer-shaped rear thrust receiving member 37. A nut 38 is threadably secured on the back end of propeller shaft 13 so as to maintain the relative axial position of propellers 31 and 32. As in the first embodiment, the rear propeller 32 in the second embodiment does not have its own shock-absorber. However, because of the engagement of toothed engagement areas 34D and 35D, propeller 32 is linked to shock-absorber 35 through propeller 31.

Figure 9:
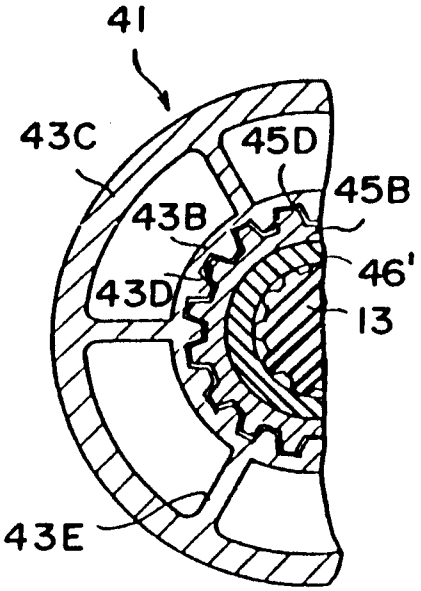
FIG. 9 is a partial, cross-sectional view taken along line E—E in FIG. 8.
Figure 8:
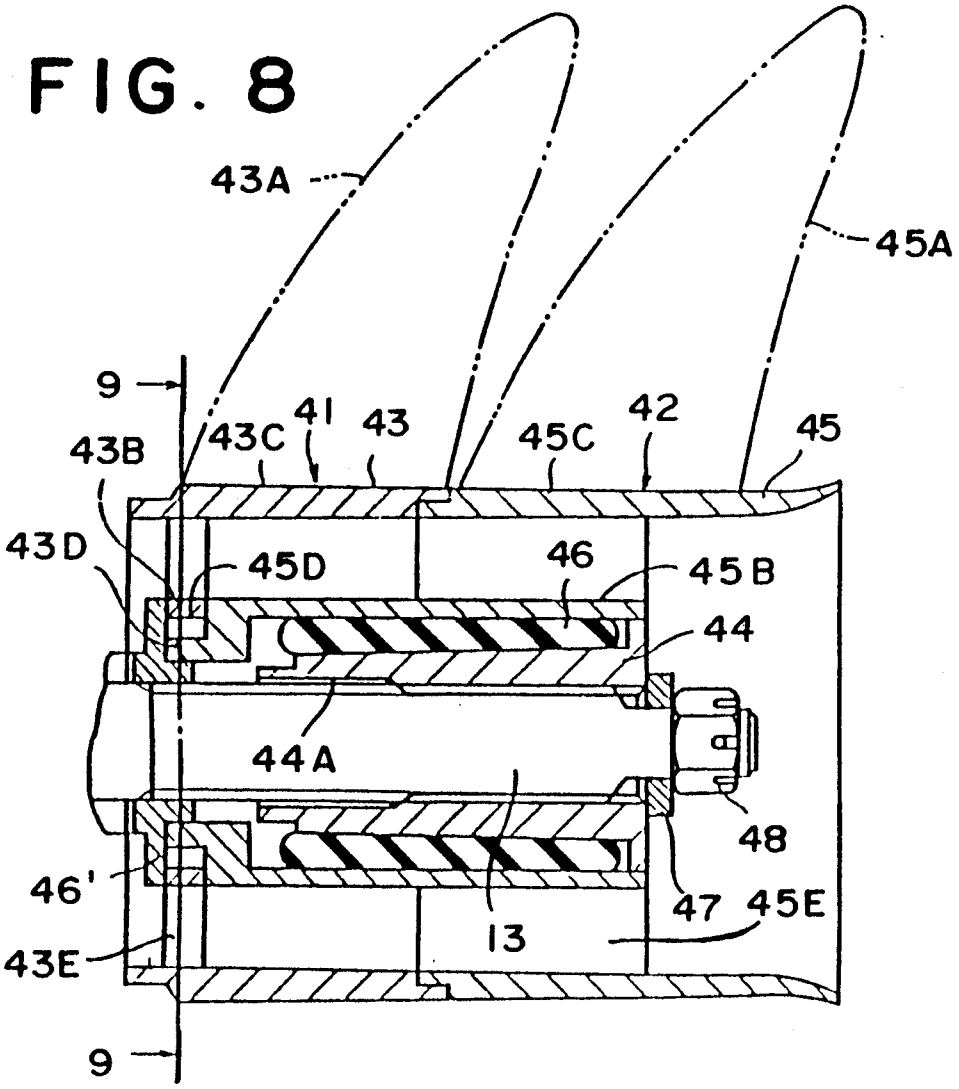
FIG. 8 is a cross-sectional view of a third tandem propeller assembly embodiment of the invention.

Reference will now be made to FIGS. 8 and 9 in describing a third embodiment of the invention which differs from the first two embodiments described above with respect to the attachment structure for the tandem propellers. In the third embodiment, front propeller 41 includes a collar 43 which carries blades 43A. Collar 43 is composed of a short inside cylinder 43B and an outside cylinder 43C connected by spokes 43E. The inside diameter of inside cylinder 43B is splined at 43D.

An inner collar 44 is spline connected at 44A to propeller shaft 13 and is connected to an inside cylinder 45B of propeller 42 by an elastic shock-absorber 46. Again, shock-absorber 46 is preferably made of rubber which is fuse bonded in place between inner collar 44 and inside cylinder 45B. Propeller 42 further includes an outside cylinder 45C which together with inside cylinder 45B and spokes 45E constitutes an outer collar 45 of propeller 42. At the front end of inside cylinder 45B a splined area 45D is formed. Splined area 45D is formed on the outside diameter of inside cylinder 45B and is interengaged with splines 43D formed on the inside diameter of inside cylinder 43B of propeller 41. By this arrangement, drive from propeller shaft 13 is transmitted through inner collar 44 and shock-absorber 46 to propeller 42 and to propeller 41 through the spline connection between inside cylinder 43B and inside cylinder 45B. Again, both propellers 41 and 42 are mounted on propeller shaft 43 between a forward thrust receiving member 46 and washer-shaped rear thrust receiving member 47. Propellers 41 and 42 are held in their axial position by a nut 48 threaded on the rear end of propeller shaft 13.

As in the previously described embodiments, only one of the propellers in this embodiment has its own shock-absorber. In this third embodiment, it is the rear propeller 42 which is provided with its own shock-absorber 46. However, due to the linkage between the splines 43D and 45D, the front propeller 41 is also linked to shock-absorber 46.

Figure 11:
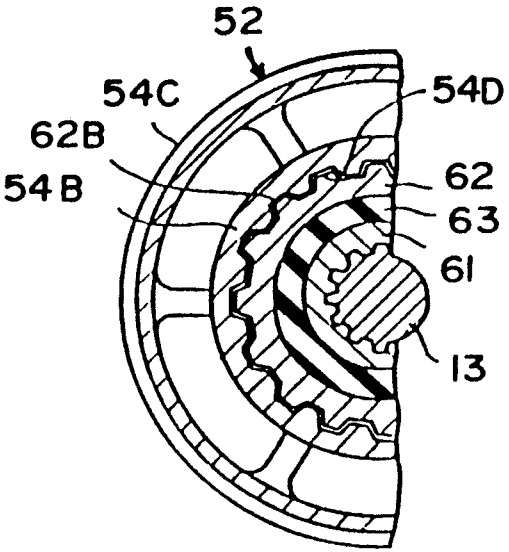
FIG. 11 is a partial, cross-sectional view taken along line F—F in FIG. 10.
Figure 10:
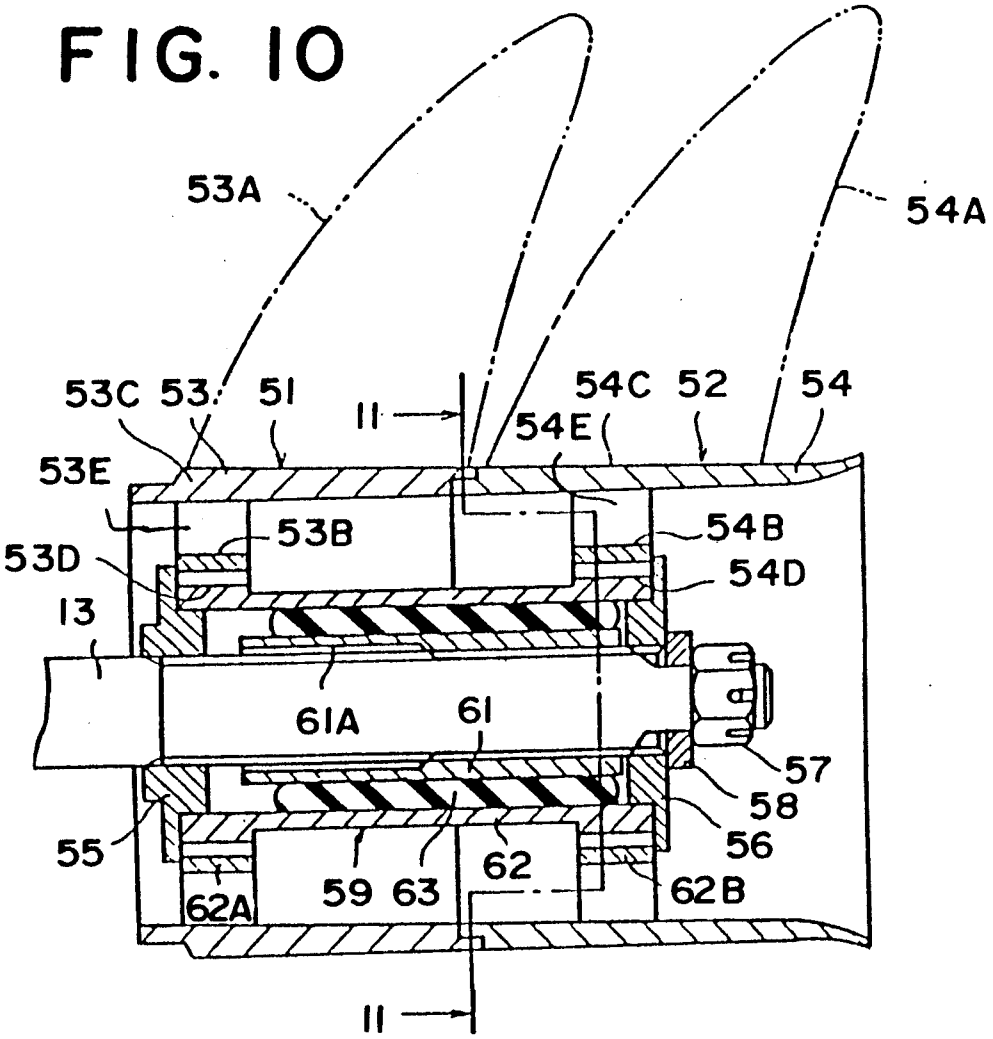
FIG. 10 is a cross-sectional view depicting a fourth tandem propeller embodiment according to the present invention.

A fourth embodiment of the invention is depicted in FIGS. 10 and 11. In this embodiment, front propeller 51 includes a collar 53 which carries blades 53A. Collar 53 has a short inside cylinder 53B and an outside cylinder 53C connected by spokes 53E. The inside diameter of inside cylinder 53B is formed with a plurality of splines 53D. Rear propeller 52 is composed of a collar 54 which carries blades 54A. Collar 54 has a short inside cylinder 54B and an outside cylinder 54C connected by spokes 54E. The inside surface of inside cylinder 54B includes a plurality of splines 54D. Both propellers 51 and 52 are mounted about propeller shaft 13 between a forward thrust receiving member 55 and a rear thrust receiving member 56. Propellers 51 and 52 are held in their axial position by means of a nut 57, threadably attached to an end portion of propeller shaft 13, and a washer 58.

In this embodiment, both propellers 51 and 52 are attached to propeller shaft 13 via a shock-absorber assembly generally indicated at 59. Shock-absorber assembly 59 comprises an inner collar 61 which is spline connected to propeller shaft 13 at 61A, an inner intermediate cylinder 62 which is provided with front and rear outer circumferential splines 62A and 62B and an elastomeric shock-absorber 63 which is fuse bonded between inner collar 61 and inner intermediate cylinder 62. Splines 53D of propeller 51 are interengaged with splines 62A formed at the front end of inner intermediate cylinder 62 and splines 54D of propeller 52 are interengaged with splines 62B. By this arrangement, both propellers 51 and 52 share common shock-absorber 63 and are driven by propeller shaft 13 through shock-absorber assembly 59 which provides damping effects for both propellers 51 and 52.

Although described with reference to various preferred embodiments of the invention, it is to be understood that various changes and/or modifications can be made to the present invention without departing from the spirit of the invention. In addition, although each of the embodiments were described with reference to an outboard engine, it should be readily understood that each of the tandem propeller arrangements could equally be utilized in combination with inboard/outboard or inboard propulsion units. In general, the invention is only intended to be limited by the scope of the following claims.

We claim:

1. A tandem propeller assembly for use in a marine propulsion unit including a drive shaft, comprising:
   a first propeller unit;
   a second propeller unit located in tandem relative to the first propeller unit;
   corotation connector means for positively drivingly connecting the first and second propeller units together for corotation in the same direction;
   a single shock absorber; and
   drive connecting means for drivingly interconnecting at least one of the propeller units to a drive shaft through said single shock absorber such that said single shock absorber protects the marine propulsion unit from damage in the event that either of the propeller units is obstructed by debris during operation.

2. A tandem propeller assembly as claimed in claim 1, wherein said corotating connector means comprises a spline connection between said propeller units.

3. A tandem propeller assembly as claimed in claim 1 or 2, wherein said shock absorber is an elastic member.

4. A tandem propeller assembly as claimed in claim 1 or 2, wherein said drive connecting means comprises at least an inner collar adapted to engage a drive shaft in driving relationship and an inner cylinder drivingly connected to at least one propeller unit, and wherein said shock absorber is connected between said inner collar and inner cylinder so as to transmit rotary motion between said inner collar and inner cylinder.

5. A tandem propeller assembly as claimed in claim 4, wherein said inner collar and inner cylinder are concentrically arranged, and said shock absorber comprises an elastic member sandwiched between and engaging in driving relationship said inner collar and inner cylinder.

6. A tandem propeller assembly as claimed in claim 5, wherein said inner cylinder is directly connected only to one propulsion unit.

7. A tandem propeller assembly as claimed in claim 1, wherein said drive connecting means is arranged to directly drivingly connect only one propeller unit to a drive shaft.

8. A tandem propeller assembly as claimed in claim 7, said drive connecting means including an inner collar adapted to be drivingly connected to a drive shaft and said first propeller unit comprising a first inner cylinder;
   said inner collar disposed concentrically with said first inner cylinder;
   said shock absorber comprising an elastic member sandwiched between said inner collar and said first inner cylinder, and said elastic member connecting in driving relationship said inner collar and first inner cylinder.

9. A tandem propeller assembly as claimed in claim 8, wherein said corotation connector means includes a spline connector arrangement.

10. A tandem propeller assembly as claimed in claim 8, wherein said second propeller unit comprises a second inner cylinder; and
   wherein said corotation connector means comprises a corotation connector between said first and second inner cylinders.

11. A tandem propeller assembly as claimed in claim 8, wherein said first and second propeller units respectively comprise first and second outer cylinders, and wherein said corotation connector means comprises a corotation connector between said first and second outer cylinders.

12. A tandem propeller assembly as claimed in claim 10 or 11, wherein said corotation connector comprises radially and axially extending interconnected spline elements.

13. A tandem propeller assembly as claimed in claim 1, said first and second propeller units respectively comprising first and second inner cylinders;

said drive connecting means comprising an inner collar adapted to engage a drive shaft in driving relationship and an inner intermediate cylinder;

said shock absorber connecting said inner collar and said inner intermediate cylinder together so as to transmit rotary motion between said inner collar and said inner intermediate cylinder;

said corotation connector means comprising corotation connectors connecting said inner intermediate cylinder and said first and second inner cylinders of said propeller units in driving relationship.

14. A tandem propeller assembly as claimed in claim 13, wherein said inner intermediate cylinder is concentric with said inner collar and said shock absorber comprises an elastic member sandwiched between said inner collar and said inner intermediate cylinder so as to transmit rotary motion between said inner collar and inner intermediate cylinder.

15. A tandem propeller assembly as claimed in claim 13 or 14, wherein said corotation connectors comprise radially and axially extending interconnected spline elements.

16. A tandem propeller assembly for use in a marine propulsion units comprising:

a drive shaft;

a first propeller unit;

a second propeller unit;

a single shock absorber arranged between said drive shaft and each of said propeller units; and drive connecting means for drivingly connecting said first and second propeller units to said drive shaft for rotation in the same direction through said single shock absorber such that said single shock absorber protects the marine propulsion unit from damage in the event that either of the first and second propeller units is obstructed by debris during operation.

17. A tandem propeller assembly as claimed in claim 16, wherein said shock absorber comprises an elastic member secured between said drive shaft and at least one of said propeller units.

18. A tandem propeller assembly as claimed in claim 16 or 17, wherein said shock absorber is secured only between said drive connecting means and one of said propeller units, and the other of said propeller units is driven by said drive shaft through said one propeller unit.

19. A tandem propeller assembly as claimed in claim 18, wherein said shock absorber drivingly and resiliently connects the drive shaft to said one propeller unit.

20. A tandem propeller assembly as claimed in claim 17, wherein said at least one propeller unit comprises an outer collar including an outer cylinder and an inner cylinder drivingly connected to the outer cylinder, and radially spaced from said outer cylinder;

said drive connecting means including an inner collar member radially spaced from the inner cylinder and which is driven by said drive shaft; and wherein said elastic member is sandwiched between said inner collar and said inner cylinder in driving relationship.

21. A tandem propeller assembly as claimed in claim 20, wherein said elastic member is fuse bonded to said inner collar and said inner cylinder.

22. A tandem propeller assembly as claimed in claim 20, wherein in said elastic member is secured only between said drive connecting means and one of said propeller units;

wherein the other propeller unit also includes an outer collar including an other outer cylinder drivingly connected to an other inner cylinder radially spaced from said other outer cylinder of said other propeller unit, and the other inner cylinder of said other propeller unit being drivingly connected to the drive shaft via said inner cylinder of said one propeller unit.

23. A tandem propeller assembly as claimed in claim 20, wherein the other propeller unit also includes an outer collar and an inner cylinder, and the outer collars of said propeller units are drivingly interconnected.

24. A tandem propeller assembly as claimed in claim 16, including corotation connector means for positively connecting together said propeller units for corotation.

25. A tandem propeller assembly as claimed in claim 16, wherein said drive connecting means is arranged to drivingly connect only one of said first and second propeller units to the drive shaft, and corotation connector means for positively connecting together said propeller units for corotation.

26. A tandem propeller assembly as claimed in claim 21, each of said propeller units including concentric outer and inner cylinders drivingly connected together, said corotation connector means connecting said inner cylinders together.

27. A tandem propeller assembly as claimed in claim 21, each of said propeller units including concentric outer and inner cylinders drivingly connected together, said corotation connector means connecting said outer cylinders together.

28. A tandem propeller assembly as claimed in claims 24, 25, 26 or 27, said corotation connector means comprising radially and axially extending interconnected spline elements.

29. A tandem propeller assembly as claimed in claim 24, each of said propeller units including concentric outer and inner cylinders drivingly connected together;

said drive connecting means including an inner intermediate cylinder;

said corotation connector means connecting together said inner intermediate cylinder and said inner cylinders of said propulsion units;

said shock absorber disposed between said drive shaft and said inner intermediate cylinder.

30. A tandem propeller assembly as claimed in claim 29, wherein said corotation connector means comprises axially and radially extending interconnected spline elements.

* * * * *